US006461147B1

(12) United States Patent
Sonju et al.

(10) Patent No.: US 6,461,147 B1
(45) Date of Patent: Oct. 8, 2002

(54) GAS BURNER

(75) Inventors: Otto K. Sonju; Morten Fossum; Nils A. Rokke, all of Trondheim (NO)

(73) Assignee: Leiv Eiriksson Nyfotek AS, Trondheim (NO)

( * ) Notice: Subject to any disclaimer, the term of this patent is extended or adjusted under 35 U.S.C. 154(b) by 0 days.

(21) Appl. No.: 09/807,419

(22) PCT Filed: Oct. 21, 1999

(86) PCT No.: PCT/NO99/00320

§ 371 (c)(1),
(2), (4) Date: Jul. 7, 2001

(87) PCT Pub. No.: WO00/25065

PCT Pub. Date: May 4, 2000

(30) Foreign Application Priority Data

Oct. 23, 1998 (NO) ..... 19984956

(51) Int. Cl.[7] ..... F23C 7/00
(52) U.S. Cl. ..... 431/187; 431/182; 431/183
(58) Field of Search ..... 431/180–189, 431/284, 353, 9, 8, 215, 174, 175

(56) References Cited

U.S. PATENT DOCUMENTS

| | | | | |
|---|---|---|---|---|
| 3,118,493 A | * | 1/1964 | Walstad | 431/183 |
| 4,952,136 A | * | 8/1990 | Collins, Jr. et al. | 431/183 |
| 5,388,536 A | * | 2/1995 | Chung | 431/183 |
| 5,407,347 A | * | 4/1995 | Bortz | 431/183 |
| 5,505,615 A | * | 4/1996 | Wittaveen | 431/187 |

FOREIGN PATENT DOCUMENTS

| | | |
|---|---|---|
| DE | 3835354 | 4/1990 |
| FR | 1232372 | 10/1960 |

OTHER PUBLICATIONS

NORSK VVS, vol. 5, 1997, ROKKE, pp. 23–26 & Figure 5.
Abstract No. 88–97395/14 of SU 1333963, Aug. 30, 1987.
Abstract No. 89–121042/16 of SU 1430553, Oct. 15, 1988.
Abstract No. 89–262105/36 of SU 1442790, Dec. 7, 1988.
Abstract No. 93–318484/40 of SU 1763806, Sep. 23, 1992.

* cited by examiner

*Primary Examiner*—James C. Yeung
(74) *Attorney, Agent, or Firm*—Dennison, Schultz & Dougherty

(57) ABSTRACT

A gas burner includes a tubular shaped housing having a proximal end and a distal end, the housing tapering inwardly to an outlet at the distal end to form a truncated cone. A gas supply tube is disposed longitudinally centrally within the housing and extends from the proximal end to a point adjacent the distal end in a combustion zone and terminates in a closed end wall, the supply tube and the housing defining therebetween an annular space for supply of air to the combustion zone at a pressure slightly above atmospheric. A vortex generator is disposed upstream of the distal end of the housing and includes a plurality of baffle flights extending longitudinally within the housing a radially from the gas supply tube to the inner wall of the housing, thereby supporting the gas supply tube. The gas supply tube defines a plurality of radially arranged openings therein disposed between the vortex generator and the closed end wall, the openings being disposed at a distance from the end wall which is one to four times the diameter of the tube. The baffle flights have an aerodynamically curved shape to produce a helical movement to air which passes therethrough and which mixes with gas exiting the openings in the gas supply tube.

4 Claims, 1 Drawing Sheet

GAS BURNER

BACKGROUND OF THE INVENTION

The invention relates to a gas burner particularly for use in ovens, incinerators etc.

DESCRIPTION OF RELATED ART

In the periodical Norsk VVS, 5/97 a burner is disclosed with low emissions of polluting exhaust gases. The burner has a cylindrical burner housing at one end of which combustion air may be introduced. Centrally in the burner housing and extending coaxially with the housing, a tubing or lance is arranged, into one end of which a gaseous fuel such as propane is to be introduced. At the other end of the tubing a series of radially extending holes is provided through which the gas can enter and mix with the combustion air. The end of the tubing is closed with a wall. Upstream of the holes, between the tubing and the burner housing, baffle plates are arranged in a radial pattern for tangential deflection of the combustion air so that it will flow in a vortex, i.e., helically within and along the walls of the burner housing, downstream of the baffle plates.

This burner has acceptable performance with respect to $NO_x$ content in the exhaust gases and with respect to flame stability. By flame stability is meant the burner's ability to maintain the flame under varying flow conditions and for variations in the relative proportions of supplied fuel and air. A $NO_x$ content as low as 40 ppm can be obtained with propane. The burner is, however, not well suited for the use of natural gas as the fuel source, as this leads to low flame stability and a high content of CO and unburned hydrocarbons in the exhaust gases.

From the periodical Norsk VVS it is also known to conduct a partial pre-mixing of gas and air, wherein the gas is introduced to the air upstream and downstream relative to the baffle plates.

EP patent application No. 672 865 (General Electric Company) discloses a burner for a gas turbine, where gas is introduced radially between baffle plates and a burner head. This burner is adapted for use with gas under high pressure and is not suited for low pressure burners.

U.S. Pat. No. 3,469,790 (Duncan) discloses a burner head with radial baffle plates, wherein gaseous fuel is introduced both between the baffle plates and just upstream of the baffle plates. This solution is characterized by a short mixing time which causes an inhomogeneous mixture and high emissions of $NO_x$. The concept of this patent is primarily developed for adaption of the flame to different burner housings and not for low emission of pollution.

SUMMARY OF THE INVENTION

The main object of the invention is the provision of a one-step burner with partial pre-mixing and premixing which enables the use of relatively light fuel gases with no performance reduction and with acceptable stability. Heavy gases in the context of this specification would be, e.g. propane, butane and mixtures of these (LPG), whereas light gases include, e.g. natural gas with the naturally occurring variations (LNG, CNG). "Special gases" would be, e.g. hydrogen, carbon monoxide and mixtures of these, as well as low value gases.

It is a further object to provide a burner which gives lower emissions of $NO_x$ and CO compared to previously known burners. This is to be obtained in combination with a high flame stability and a high level of available adjustment possibilities.

With the burner according to the present invention, good flame stability and low emissions of pollution can be achieved with seemingly unfavorable mixtures of fuel and air. This is achieved utilizing:

- a partially pre-mixed fuel/air mixture flowing along the gas tube, which creates a fuel rich shear layer,
- a hot backwards and centrally flowing exhaust gas continuously igniting the above mentioned gas mixture and thereby ensuring good stability, and
- a main flow of mixed air and fuel which becomes ignited and burns at a low temperature outside the conical end of the flame tubing.

BRIEF DESCRIPTION OF THE DRAWINGS

The invention will be further described hereinafter with reference to the accompanying drawings, where.

DESCRIPTION OF THE PREFERRED EMBODIMENTS

Figure 1:
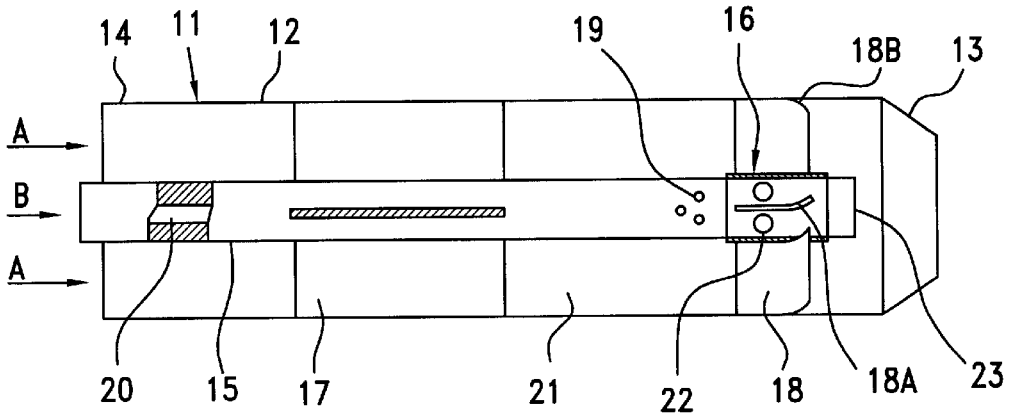
FIG. 1 is a sectional, longitudinal schematic view through a first embodiment of a burner according to the invention.

FIG. 1 shows a burner which comprises an outer tubing or tube shaped burner housing 11 with a cylindrical main portion 12 which on its downstream end on the right hand side of the drawing is integrally connected to a conical end portion 13 which tapers off in the direction away from the cylindrical portion 12. The left end 14 of the burner housing 11 constitutes the inlet end and the conical portion 13 constitutes the outlet end.

An inner tubing or gas tube 15 extends through the main portion 12 of the burner housing coaxially with the housing, the left end of said tubing which constitutes the inlet end, projects a small distance from the inlet end of the burner housing 11. At the right hand end of the tubing a vortex generator 16 is arranged which ends somewhat upstream of the conical portion 13. The gas tube 15 is sealed with an end wall 23. Upstream of the middle section of the burner housing 11, between the gas tubing 15 and the burner housing 11, a circumferential row of radially and generally axially arranged baffle plates 17 is provided, the function of which is to direct the flow uniformly in an axial direction. The example shows four such baffle plates 17. At the right hand end of the gas tube 15 on the member designated vortex generator 16, a six generally radially extending baffle flights 18 are attached. The baffle flights according to the example are designed such that their inlet is axially directed, the middle section 18*a* is curved, and at the outlet end, the baffle flights have a straight portion which stands at an angle to the center line of the gas tube 15. The baffle plates 17 and the baffle flights 18 are spaced apart evenly with respect to one another along the circumference of the gas tube 15. Gas is supplied to gas tube 15 slightly in excess of atmospheric pressure.

Upstream of the baffle flights 18 of the vortex generator 16, the gas tube 15 is provided with circumferentially or radially arranged holes or sets of holes 19. The holes thereby lie in two radial planes axially upstream of the vortex generator 16. Alternatively the holes may be arranged in one plane only or in more than two planes. According to the example the holes 19 are radially displaced relative to one another around the circumference, the example illustrating eight holes. The holes 19 can be localized upstream of the baffle flights 18 with a distance of from one to five times the diameter of the gas tube 15. The interior 20 of the gas tube 15 communicates through the holes 19 with an annular space 21 between the burner housing 11 and the gas tube 15.

Alternatively the gas supply may be arranged by means of pipe conduits which project into the space between the burner housing 11 and the gas tube 15.

In another embodiment an alternative row of radially spaced apart holes or sets of holes 22 may be arranged through the wall of the gas tube 15 at the level of the baffle flights, as indicated with broken lines. The holes 22 are shown in one plane, but like the holes 19 they can also be arranged in two or more planes spaced apart axially.

A light gas, like LNG, methane etc. may be pumped into the inlet end of the gas tube 15 and will flow through the holes 19 upstream of the baffle flights 18. Combustion air is blown in at the inlet end of the burner housing as indicated by the arrows A and flows into the annular spacing 21 between the burner housing 11 and the gas tube 15. When the air flow passes the baffle plates 17 any rotation or vortex in the air stream is slowed or halted so that the air stream downstream of the baffle plates is mainly unidirectional and axially oriented.

In the region upstream of the baffle flights 18 the fuel gas is added to this axially oriented air stream. When the air stream with added fuel gas passes the baffle flights 18, it is forced into rotation in one direction around the burner's longitudinal axis, so that it will flow helically between the gas tube 15 and the burner housing 11 downstream of the baffle plates 18. Hence, downstream of the baffle flights 18, past the vortex generator 16 and through the conical portion 13, the air rotates around the longitudinal axis of the burner housing, whereas the static air pressure increases in the radial direction. Part of the air stream downstream of the conical portion, i.e. to the right of FIG. 1, may, due to the greater positive pressure gradient at the axial outer portion of the stream, flow in the opposite axial direction, i.e. towards the left on the drawing close to the burner's longitudinal axis, and thereafter flow radially outwardly immediately downstream of the baffle flights 18. This counterflow will take place between a stagnation point downstream of the conical portion and a stagnation point close to the end wall 23 of the gas tube 23.

In an alternative embodiment, for a heavier gas, like LPG, propane etc., alternative holes at the level of the baffle flights may be arranged, as described above.

In both cases a partial or complete pre-mixing of the air and the fuel gas is obtained prior to ignition of the mixture by means of an ignition device such as an electrode (not shown) which is arranged in the shear layer region, i.e. the annular region where air is flowing out from and exhaust gases are flowing in to the axis of the tubing, and where a shear layer flow occurs. After the mixture has been ignited, the burning air/gas mixture effects a continuous ignition of not yet ignited amounts of such a mixture.

Figure 3:
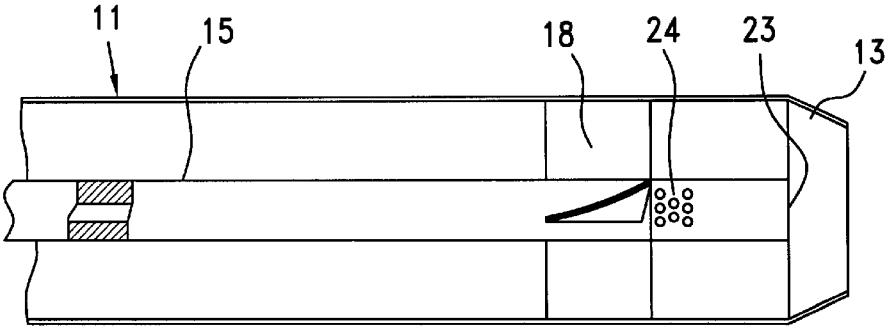
FIG. 3 is a sectional schematic view through a further embodiment of the invention.

FIG. 3 depicts an embodiment which is particularly suited for light gas and/or for low gas pressure.

Here the same elements as in FIG. 1 are shown with the same reference numerals: burner housing 11, gas tube 15, vortex generator 16 with baffle flights 18 which extend outwardly to the wall of the burner housing. The gas tube 15, which can have a diameter of ¼ of the burner housing 11, extends to the passage between the burner housing and its conical portion 13. The distance between this end of the gas tube and the downstream end of the baffle flights (18) is in the range of 1–4 times the diameter of the gas tube.

Close downstream of the downstream end of the baffle flights, one or more (three are shown) mutually spaced rows of holes 24 are arranged circumferentially through the wall of the gas tube. The number of holes in each row can be eight.

In FIG. 3 the baffle plates 17 from the example above are omitted, since the flow of combustion air that reaches the vortex generator should be unidirectional in advance.

Tests have shown that this design gives satisfactory results for particularly low gas pressures, where, by appropriate design the inlet portion of the gas tube or by the use of a fan, the flow of combustion air is ensured to be unidirectionally oriented to a certain degree.

It should be noted that for burners operating with completely premixed air and fuel, a gas/air proportion which deviates from stoichiometric is applied, which in turn gives a less than optimal stability.

In diffusion burners where gas and air are mixed directly in the combustion chamber, there will be nearly stoichiometric amounts of gas and air, which is considered to give optimal stability. It has now been found, however, that the previously described design with the holes and premix of the air and gas, gives better stability and lower emissions of harmful gases.

The introduction of gas through the holes 19 (or alternatively through the holes 22 or 24) leads to a different mixing of the gas with the combustion air, depending on the proportion between the input values for the gas and the air. For example heavy propane flows three times faster into the combustion air compared to what is the case for the lighter methane at the same flow velocity. This effects a different mixing of these gases in the combustion air.

When the gas and the combustion air flow between the baffle plates 18, the direction of the flow is deflected so that a tangential flow velocity vector arises. This in turn creates a potential vortex in the burner housing and the pressure on the gas/air mixture is reduced close to the longitudinal axis of the housing. When the gas is ignited at this axial location, a hot mixture of gas and air and exhaust gases flow into the burner housing in the opposite direction of the air upstream of the baffle flights, providing a stable ignition source for new amounts of air and gas which come flowing in. In the layer between the backflowing exhaust gas and the fresh air/gas mixture which flows forward, that is from the left to the right on the drawing, a region of high shear stress arises. This shear layer region effects a good intermixing which in turn effects a very good flame stability. The partially or completely premixed composition is ignited at this point and forms a flame in the burner housing 11 as the burning gases are further accelerated through the tapered, conical portion 13.

The improved mixing process obtained with the burner of the [present] invention ensures a lower emission of $NO_x$ and CO, the relative amounts of these gases in the exhaust gases being approximately 50% lower compared to the situation for the burner configuration described in Norsk VVS. The increased stability is caused by the intense mixing process upstream and downstream of the baffle flights and between the flights.

The burner according to the invention may as indicated be applied to heavier gases, where similar results may be achieved. The velocity of the air/gas mixture in the space between the baffle flights 18, is higher than the flame propagation rate in this mixture, so the flame front will not be displaced upstream of this point.

While it is indicated above that radial holes in the gas tube constitute the means for the outlet of the gas, such means may also be provided by radially oriented tubes projecting from the gas tube 15 into the annular space 21 between the burner housing 11 and the gas tube 15. Using such means, even better intermixing can be achieved for special gases like CO, $H_2$, biogas compositions or other gases with a density of less than 0.65 kg/$Nm^3$, or mixtures of these with natural gas.

Preferably the diameter of the holes or the tubing openings is so dimensioned such that gas velocity therethrough will be between 5 and 70 m/s.

If holes are arranged in several transverse planes, the holes of the different planes may be arranged so that they do not overlap each other in the axial direction.

It has been found that for the proper functioning of the burner, it is advantageous if the proportion between the baffle flights' length and the space between flights be at least 1:1.

For the same reason the baffle flights 18 should be arranged in a manner that gives a deflection of the air/gas stream of at least 50°, as compared to the longitudinal direction of the burner housing. For this flow a flow vortex number may be defined as follows:

$$S = \frac{2(1-(d_h/d)^3)\tan\beta}{3(1-(d_h/d)^2)}$$

where $d_h$ is the diameter of the gas tube 15, d is the internal diameter of the burner housing 11, and β is the angel between the baffle flight outlet portion and the longitudinal axis of the housing. The value for the vortex number S should preferably be between 1 and 3 for the burner to work properly.

Furthermore the Reynolds number (Re) should be between 5000 and 300 000, where this number is applicable for the outlet portion of the burner and for the main flow.

The ratio between the diameter of the burner tubing 12 at its outlet end at the conical portion 13 and the inner diameter of the burner tubing's main body, should preferably be in the range 0.7–0.8.

Figure 2:
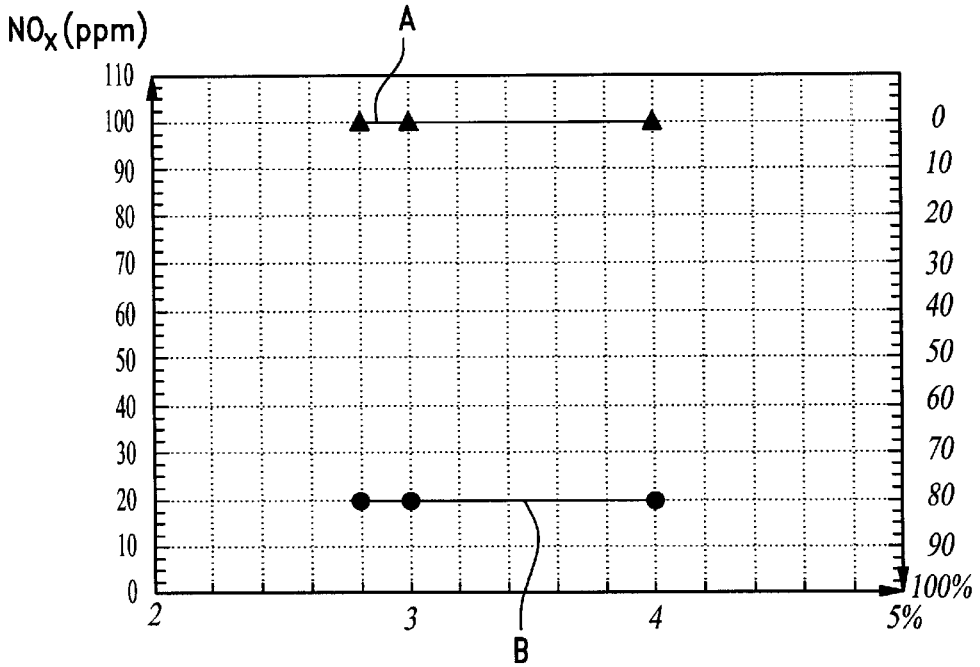
FIG. 2 is a diagram showing measured data for a burner according to the invention as well as for two conventional burners.

FIG. 2 shows a diagram of measured data for a burner according to the invention and a burner according to previously known technology. The upper graph A shows measured data for a known burner while the lower graph B shows measured data for a burner according to the invention.

The left ordinate shows the $NO_x$, emission in ppm corrected to 3% $O_2$. The right ordinate shows achieved percentage reduction compared to a standard burner, and the abscissa shows volume-% of $O_2$.

In certain cases it may be advantageous to arrange an outlet opening in more than one of the positions 19, 22 and 24 indicated above. The conditions for such a co-arrangement of two or more outlet openings at different locations are, however, not fully understood.

What is claimed is:

1. A gas burner comprising:

a tubular shaped housing having a proximal end and a distal end, and outer and inner walls defining an outer and inner diameter, the housing tapering inwardly to an outlet at the distal end to form a truncated cone;

a gas supply tube of defined diameter disposed longitudinally centrally within the housing and extending from the proximal end to a point adjacent the distal end in a combustion zone and terminating in a closed end wall, the supply tube and the housing defining therebetween an annular space for supply of air to the combustion zone at a pressure slightly above atmospheric;

a vortex generator disposed upstream of the distal end of the housing comprising a plurality of baffle flights extending longitudinally within the housing a radially from the gas supply tube to the inner wall of the housing, thereby supporting the gas supply tube;

the gas supply tube defining a plurality of radially arranged openings therein disposed between the vortex generator and the closed end wall, said openings being disposed at a distance from the end wall which is one to four times the diameter of the tube, wherein the baffle flights have an aerodynamically curved shape to produce a helical movement to air which passes therethrough and which mixes with gas exiting the openings in the gas supply tube.

2. Gas burner according to claim 1, additionally comprising a plurality of baffle plates arranged longitudinally and radially in the annular space upstream of the vortex generator.

3. Gas burner according to claim 1, wherein the outlet has a diameter which is 0.7 to 0.8 times the inner diameter of the housing.

4. Gas burner according to claim 1, additionally comprising openings in the gas supply tube between the baffle flights.

* * * * *